United States Patent [19]

Heard

[11] Patent Number: 4,475,652

[45] Date of Patent: Oct. 9, 1984

[54] TAPE DISPENSING PACK

[75] Inventor: Robert A. H. Heard, Backwell, England

[73] Assignee: Signfix Limited, Bristol, England

[21] Appl. No.: 468,291

[22] Filed: Feb. 22, 1983

[30] Foreign Application Priority Data

Mar. 1, 1982 [GB] United Kingdom ..... 8205890

[51] Int. Cl.[3] ..... B65D 85/67; B65D 85/04; B65H 75/40

[52] U.S. Cl. ..... 206/409; 206/389; 206/403; 206/303; 242/96

[58] Field of Search ..... 206/409, 405, 406, 411, 206/412, 397, 303, 403, 493; 242/96, 197; 225/78, 46, 47

[56] References Cited

U.S. PATENT DOCUMENTS

| | | | |
|---|---|---|---|
| 149,523 | 4/1874 | Pritchard et al. | 206/303 |
| 1,119,467 | 12/1914 | Steiner | 220/8 |
| 1,185,490 | 5/1916 | Everhart | 225/47 |
| 1,983,565 | 12/1934 | Replogle | 242/96 |
| 2,790,609 | 4/1957 | Hawthorne et al. | 206/403 |
| 3,260,360 | 7/1966 | Davis | 206/349 |
| 3,349,979 | 12/1967 | Costello | 225/47 |
| 3,568,947 | 3/1971 | Oprins | 242/96 |

FOREIGN PATENT DOCUMENTS

| | | | |
|---|---|---|---|
| 2624880 | 12/1977 | Fed. Rep. of Germany | 242/197 |
| 1336770 | 7/1963 | France | 206/409 |
| 645955 | 9/1962 | Italy | 206/409 |
| 411621 | 11/1966 | Switzerland | 206/412 |
| 905480 | 9/1962 | United Kingdom . | |
| 1210142 | 10/1970 | United Kingdom . | |
| 2018223 | 10/1979 | United Kingdom . | |

*Primary Examiner*—William T. Dixson, Jr.
*Assistant Examiner*—Brenda J. Ehrhardt
*Attorney, Agent, or Firm*—William R. Hinds

[57] ABSTRACT

A coil of steel banding tape is contained within a flat toroidal container. The end of the tape is withdrawn from an aperture in the outer peripheral wall of the container, and the central space in the container is large enough to admit the human arm, so that the pack can be carried on site on the arm of the user. The flat annular walls are in fact preferably slightly convex in profile between the inner and outer peripheral walls so that the coil is not clamped by the user gripping the pack in one hand. The inside surface of the outer peripheral wall is preferably also provided with a series of inward projections to keep the tape out of contact with the inside surface of the wall.

2 Claims, 3 Drawing Figures

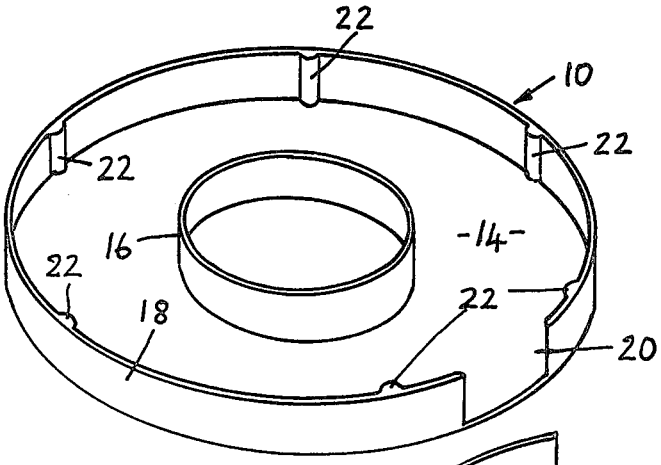
FIG 1
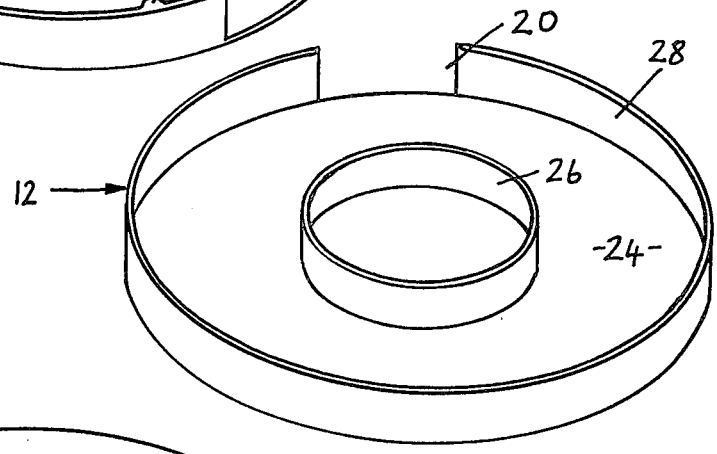
FIG 2
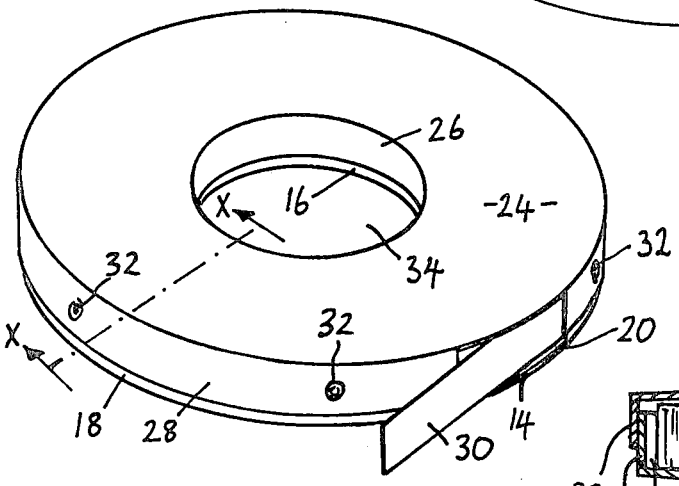
FIG 3
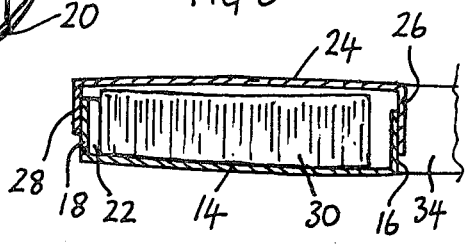

TAPE DISPENSING PACK

This invention relates to the packaging and dispensing of flexible tape, and is especially applicable to steel banding tape.

Nowadays it is common practice to attach an article such as a sign to a support such as a post by means of flexible stainless steel tape. A length of tape is drawn and cut from a reel, it is connected to the article and passed around the support and secured by a buckle. The reel of tape is normally packaged in rectangular boxes, and because these are rather cumbersome, it is usual to draw off and sever the required number of lengths of tape at some distance from the actual working site, and in order not to have lengths which are too short, a generous length is normally cut and the excess is trimmed afterwards. This obviously leads to unnecessary waste.

According to the present invention there is provided a pack comprising a flat toroidal container, having two annular walls spaced apart and bridged by radially inner and outer peripheral walls, the annular interior space thus defined containing concentrically a coil of tape, one said peripheral wall, preferably the outer wall, having an aperture through which one end of the tape can be drawn, the inner peripheral wall defining an open central space so dimensioned, suitably about 90 mm diameter or greater, as to admit the human arm. The inside surface of the outer peripheral wall is preferably provided with a series of circumferentially spaced inwardly directed projections for engaging the outer periphery of the coil of tape and preventing its contact with the major portion of said inside surface. The container is suitably made from two mouldings fitted and secured together, for example by high frequency induction welding, each said moulding comprising a said annular wall and inner and outer peripheral wall members arranged so that when the two mouldings are fitted together a peripheral wall member of one moulding fits radially inside and in contact with a corresponding peripheral wall member of the other moulding, whereby together they make up a portion of the peripheral walls joining the two said annular walls, and different widths of tape can be accommodated according to the extent to which the two mouldings are interfitted and hence the spacing between the two said annular walls. Preferably said annular walls are slightly outwardly convex in radial profile so as to resist a tendency for the tape coil to be gripped by inward flexing of the annular walls when the pack is held by a user.

The pack thus produced has a considerable advantage over conventional packaging of steel tape, in that it can be readily taken on to site, and the required amount of tape withdrawn and severed according to need. The user can insert his arm through the central space in the pack, so that he has both hands free for climbing or other manoeuvring about the site. This has been found to be of great practical benefit, and adds to safety on site. When he wishes to dispense a length of tape, the user takes the pack off his arm, and while holding the pack in one hand draws the required amount of tape with the other, and then severs it. During this operation, the pack will normally be held with the operator's hand gripping the two annular walls. Since these walls are likely to be somewhat resiliently flexible, there is a risk that too strong a grip will result in sufficient inward flexing of the walls as to grip the coil and clamp it within the container, making it difficult then to withdraw tape from the pack. The outwardly convex profile of the annular walls is intended to reduce this risk.

In order that the invention may be more clearly understood, one embodiment will now be described with reference to the accompanying drawings, wherein:

FIG. 1 shows a perspective view of the two mouldings which go to make up the container, FIG. 2 shows a perspective view of the complete pack, and FIG. 3 shows a cross-sectional view on the line X—X of FIG. 2.

Referring to the drawings, the container for the pack is made from two plastics mouldings, 10,12 respectively. The moulding 10 comprises a flat annular wall 14, with radially inner and outer peripheral wall portions 16,18, respectively upstanding therefrom. The outer radial wall portion 18 is interrupted to provide an aperture 20. The inside surface of the outer wall portion 18 is provided with a series of circumferentially spaced radially inwardly directed projections 22. The other moulding 12 likewise has a flat annular wall 24, and radially inner and outer wall portions 26,28, respectively, upstanding therefrom, and the outer wall portion 28 is likewise interrupted to provide an aperture 20. The inside diameter of the wall portion 28 of the moulding 12 is substantially the same as the outside diameter of the outer wall portion 18 of the moulding 10, while the outside diameter of the inner wall portion 26 of the moulding 12 is substantially the same as the inside diameter of the inner wall portion 16 of the moulding 10. Thus, two mouldings can be fitted together with the wall portion 28 lying radially outside and in contact with the wall portion 18, and the wall portion 26 lying radially inside and in contact with the wall portion 16. Thus, wall portions of the two parts co-operate to constitute radially inner and outer walls joining the two annular walls 14,24.

Prior to fitting the two parts of the container together, a coil of steel tape is placed concentrically in the moulding 10, so as to occupy the annular space between the inner and outer peripheral wall portions, and the outer end of the tape is extending through the opening 20. Then the moulding 12 is interfitted with the moulding 14 to an extend depending upon the width of the tape, the annular walls 14,24 being spaced apart by a distance a little greater than that width. The mouldings are secured together in this positin by suitable means such as adhesive, heat welding or, preferably, high frequency induction welding applied at intervals 32 around the outer peripheral wall, and optionally if desired around the inner peripheral wall also.

The completed pack, as shown in FIG. 2, is ready for carrying and use on site. The inner peripheral wall formed by the wall portions 16,26 defines a central space 34, preferably about 90 mm diameter or greater, which is large enough to admit the human arm, so that the pack can be carried on the arm of the user.

Referring to FIG. 3, the annular walls 14,24 are not in fact completely flat, but are slightly outwardly convex in profile. Thus, if the user holds the pack during dispensing of the tape by gripping the annular walls 14,24, the slight outward convexity of these walls should prevent their being pressed into contact with the coil of tape, thereby clamping the tape within the container and preventing its ready withdrawal from the aperture 20. FIG. 3 also illustrates the effect of a coil of steel or the like resilient tape, which tends to expand radially outwardly. If it is allowed to come into complete contact with the inside surface of the radially outer wall, the friction can be sufficient to make it difficult to withdraw the tape from the pack. To reduce this problem, the radially inward projections 22 are provided to contact the outside surface of the coil at intervals, and prevent contact of the coil with the major portion of the inside surface of the outer peripheral wall.

Although the invention has been illustrated with reference to a container having circular inner and outer peripheral walls, either or both of them could be of some other shape, such as rectangular, so long as the central space is of sufficient size to admit the human arm. The terms "toroidal" and "annular" are to be interpreted accordingly.

We claim:

1. A tape dispensing pack comprising a flat toroidal container, having two annular walls spaced apart and bridged by radially inner and outer peripheral walls, the annular interior space thus defined containing concentrically a coil of flexible resilient metal tape, the outer peripheral wall having an aperture through which one end of the tape can be drawn, the inner peripheral wall defining an open central space, the container being made from two mouldings, each comprising a said annular wall and inner and outer peripheral wall members arranged so that the same two mouldings can be telescopically interfitted to varying extents and secured to form containers of different depths to accommodate different widths of tape, a peripheral wall member of one moulding fitting radially inside and in overlapping contact with a corresponding peripheral wall member of the other moulding whereby together they make up at least a portion of the peripheral walls joining the two said annular walls, means securing the overlapping peripheral wall members together at a degree of telescopic interfitment of the two mouldings appropriate to the width of the tape in the coil, the inside surface of the outer peripheral wall being provided with a series of circumferentially spaced inwardly directed projections for engaging the outer periphery of the coil of tape and preventing its contact with the major portion of said inside surface.

2. A tape dispensing pack according to claim 1 wherein said annular walls are smoothly slightly outwardly convex in radial profile so as to resist a tendency for the tape coil to be gripped by inward flexing of the annular walls when the pack is held by a user.

* * * * *